United States Patent [19]

Johnson

[11] Patent Number: 4,893,369

[45] Date of Patent: Jan. 16, 1990

[54] HAND-HELD UTENSIL FOR SURFACE CLEANING, MOPPING AND THE LIKE

[75] Inventor: Bryan Johnson, Beauvais, France

[73] Assignee: Spontex Incorporated, New Rochelle, N.Y.

[21] Appl. No.: 196,266

[22] Filed: May 20, 1988

[51] Int. Cl.[4] ..... A47L 13/12

[52] U.S. Cl. ..... 15/119 A; 15/244.1

[58] Field of Search ..... 15/119 A, 244 A, 244 R, 15/400, 114, 115

[56] References Cited

U.S. PATENT DOCUMENTS

| | | | |
|---|---|---|---|
| 1,383,731 | 7/1921 | Leigh | 15/115 X |
| 2,683,886 | 7/1954 | Neumann | 15/114 X |
| 2,865,036 | 12/1958 | Poritz | 15/119 A |
| 3,006,010 | 10/1961 | O'Rorke | 15/119 A |
| 3,228,054 | 1/1966 | Weber et al. | 15/119 A X |
| 3,287,756 | 11/1966 | Gesell | 15/119 A |
| 3,568,233 | 3/1971 | Terzian | 15/114 X |
| 3,806,982 | 4/1974 | Park | 15/119 A |
| 4,319,379 | 3/1982 | Carrigan et al. | 15/400 |

FOREIGN PATENT DOCUMENTS

| | | | |
|---|---|---|---|
| 1427042 | 12/1965 | France | 15/119 A |

*Primary Examiner*—Chris K. Moore

*Attorney, Agent, or Firm*—Antonelli, Terry & Wands

[57] ABSTRACT

A utensil for floor cleaning and other surface treatment purposes comprising a pad, e.g., of sponge releasably attached by clips to the handles of a hinged holder. The handles form a grip for enabling the utensil to be gripped for use, and also enable the hinged parts of the holder to be pressed together to squeeze the pad.

19 Claims, 5 Drawing Sheets

HAND-HELD UTENSIL FOR SURFACE CLEANING, MOPPING AND THE LIKE

The present invention relates to utensils for surface cleaning, mopping and the like and to replaceable pads for such utensils and in particular, although not exclusively, to a hand-held utensil for domestic cleaning use.

Pads of material, particularly absorbent material such as cloths and sponges have been used for many years to clean, mop, scour and polish surfaces such as floors and kitchen units. Conventional sponge floor mops are well known which are operated from waist level by means of a broomstick-like handle; usually the handle is provided with a mechanism which enables the user to wring out the sponge.

A first aspect of the present invention is based upon an appreciation of the fact that it would be desirable to provide an improved hand-held utensil for these and other purposes.

Thus, the first aspect of the present invention provides, inter alia, a hand-held utensil for surface cleaning, mopping and the like comprising a pad of suitable surface-treatment material and holder for the pad, the holder comprising parts which are movable relative to one another from a first position in which the pad is used in normal use of the utensil to a second position in which they squeeze the pad, the holder parts having respective handles adapted to be directly gripped by the user and to enable the user to move the parts from the first, working position to the second position.

As distinct from a conventional floor mop, therefore, the presently proposed utensil is adapted to be held directly in the hand, this being based on an appreciation of the fact that for floor cleaning purposes, a significant proportion of users would prefer a utensil that requires them to bend down and exert effort directly at the point of cleaning rather than use of mop from waist level. The handles on the holder parts further enable the user to exert effort for wringing the pad directly on the pad rather than via the articulated type of mechanism found in conventional floor mops although of course for specific purposes an articulated mechanism may be provided to operate the handles, as for example where the utensil is provided on a handle to increase its reach e.g. for cleaning windows.

The pad may be made from any suitable material, such as a cloth or sponge, the particular material being determined by the use to which the utensil is to be put e.g. a cloth for polishing, an absorbent or non-absorbent sponge, such as an artificial sponge, for cleaning and mopping etc, a scouring pad for scouring or a natural or synthetic chamois leather for window cleaning and similar purposes, or a bristled or textured surface for brushing and similar. It will be appreciated that a single holder may be provided with a number of different types of pad releasable appropriate for different purposes such as cleaning, scouring, polishing, mopping etc.

The holder may be made of any suitable rigid material, such as metal, plastics or wood, although typically plastics will be used since it is a convenient material to use for mass production.

Preferably the holder comprises such holder parts which are hinged or otherwise articulated together; this may be by means of an integral hinge, so that the two parts may be swung towards one another thereby squeezing the pad.

For use with pads to be used in applications which require an efficient wringing action, such as a sponge, the width of the hinge is important, in particular so as to enable the areas of the pad furthest from the hinge line to be pressed together to a sufficient degree to provide effective wringing. Preferably, the hinge width is between 0 and twice the thickness of the pad, for example, a synthetic or cellulosic sponge pad of 23 mm thickness, a hinge width of 20 mm has been found to be optimum.

Particularly for floor cleaning and similar applications, the shape of the pad is significant. Specifically it has been found to be desirable for the two end areas to have converging lateral edges with an included angle of 90° or less, preferably about 70°, so as to provide a tapering end which facilitates cleaning into corners. These lateral edges may be straight or rounded. The overlying portions of the holder parts may be correspondingly shaped.

The handles of the holder parts also serve as a grip or grips to enable the user to hold the utensil in its normal use. For example, when the utensil is in its position of normal use, the holder parts may co-operate to form a handle extending along the holder. The two handle means may overlap lengthwise of the holder and abut side by side in their overlapping regions to form a grip which the user uses to hold the utensil in use.

The handles may be attached to the holder parts, for example, each of the handles may comprise a first part attached to and extending upwardly away from the associated holder part, and a second part extending over the associated holder part and towards and over the other holder part. The parts of the handles which extend towards the other holder part may overlap as described above to form a single grip.

For ease of use the grip formed by the two handles may be spaced from the holder parts, providing a gap to accommodate the user's knuckles when gripping the utensil.

To maintain the holder in its first position during use, a latch or detent may be provided, suitably on the handle. In the case that the handles overlap with one another, the latch or detent may be provided on this overlapping region.

The pad of surface-treatment material may be permanently fixed, or releasably and replaceably attached, to the holder. In the latter case, the releasable attachment may be achieved by co-operating means on the holder parts and the pad; for example, the pad and/or the holder may be provided with resiliently deformable elements, preferably located in the region of the holder parts where the corresponding handle means are attached, or the pad may be provided with a resiliently deformable rim which can be fitted over the edges of the holder parts or vice versa. Alternatively any other releasable systems such as screws, other resilient clips, and so forth maybe used.

Although generally a unitary pad will be attached to the two holder parts, the pad may be in two or more parts (e.g. separated at the hinge); these parts may be attached to a common backing which carries the fixings for attaching the pad as a whole to the holder. Further, where the pad is in two parts, the parts may be of different material e.g. an absorbent sponge part on one holder part, and a scouring or abrasive part on the other holder part to give a dual cleaning and scrubbing action.

In the position of normal use, the holder parts of the utensil preferably lie along a single plane, and the pad attached to the holder parts also lies along this plane, and since the lower surface of the pad to be used for cleaning, mopping, scouring, polishing, etc., will generally be parallel to the surface of the holder parts to which the pad is attached, in its normal use position this lower surface of the pad used for cleaning, etc., will be planar.

Auxiliary functions such as brushing or scraping may be provided by means of formations or attachments on the holder. For example a ridge of tough material may be provided on the front part of one of the handle means to act as a scraper for use in removing dirt etc. encrusted on the surface to be cleaned.

The present invention also provides a method which comprises fitting to a holder a pad of suitable surface-treatment material to produce a utensil according to the first aspect of the invention.

The invention further provides a pad of material for cleaning or other surface treatment or similar purposes, which is adapted to be releasably attached to the holder by one or more resiliently deformable clipping elements on one of the holder and pad engageable with complementary fixing(s) on the other.

The invention will now be further described with reference to the attached drawings in which.

FIGS. 1 to 5 show an embodiment of the invention incorporating the various features above described. The utensil comprises a holder 1 to which is releasably attached by means of resiliently deformable clip tabs 10*a*,10*b*, a pad 5 of sponge or other material suitable to the purpose of the utensil, in this case floor cleaning. The holder 1 comprises two generally similar holder parts respectively comprising mounting plates 1A, 1C for the pad 5, these being articulated together by means of two parallel integral hinges 2 disposed to either side of a relatively narrow central strip-like part 1B, and handles 3A, 3B which serve the dual functions of (a) providing operating handles enabling the user to pivot the parts 1A, 1C towards one another to squeeze or wring out the pad 5 and (b) providing a handle in the unpivoted, FIG. 1, condition by means of which the user can hold the utensil and use it to wipe the floor.

In its first position, the position in which the utensil is normally used (FIG. 1), the holder parts 1*a*, 1*b*, 1*c* conform to a common plane.

Figure 1:
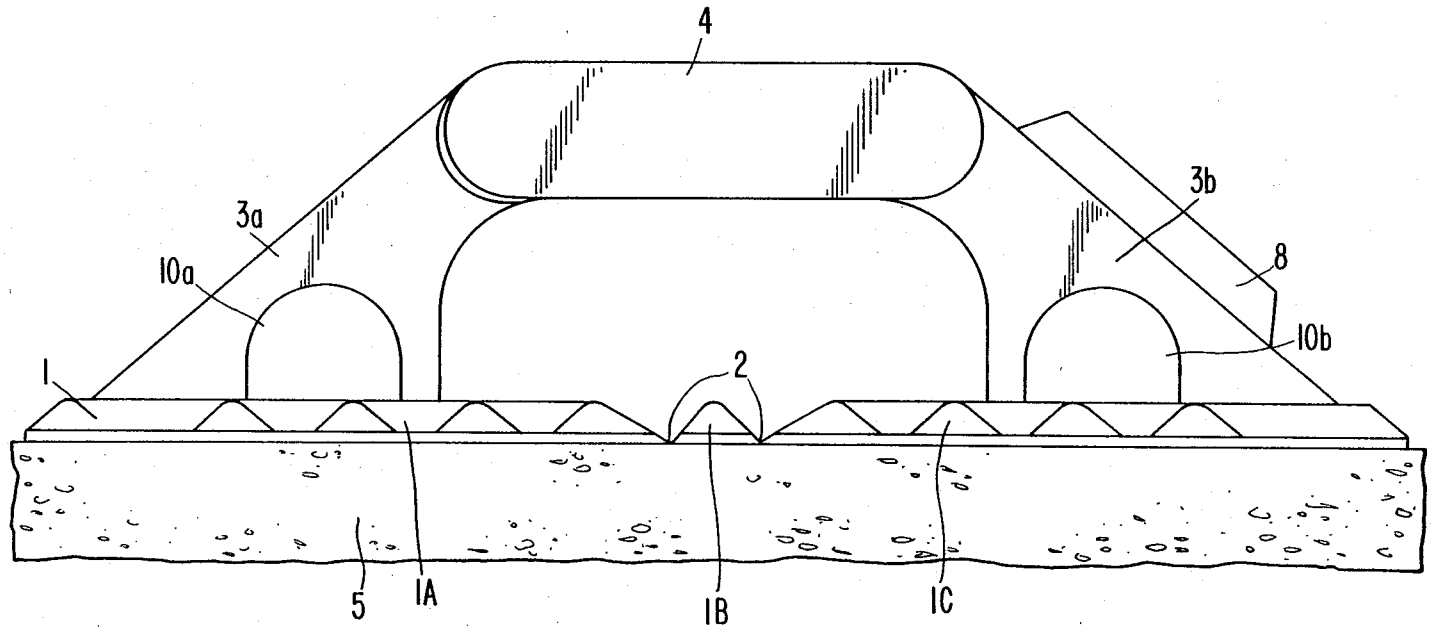
FIG. 1 shows a side view of the utensil in its first position, that in which it is normally used.
Figure 4:
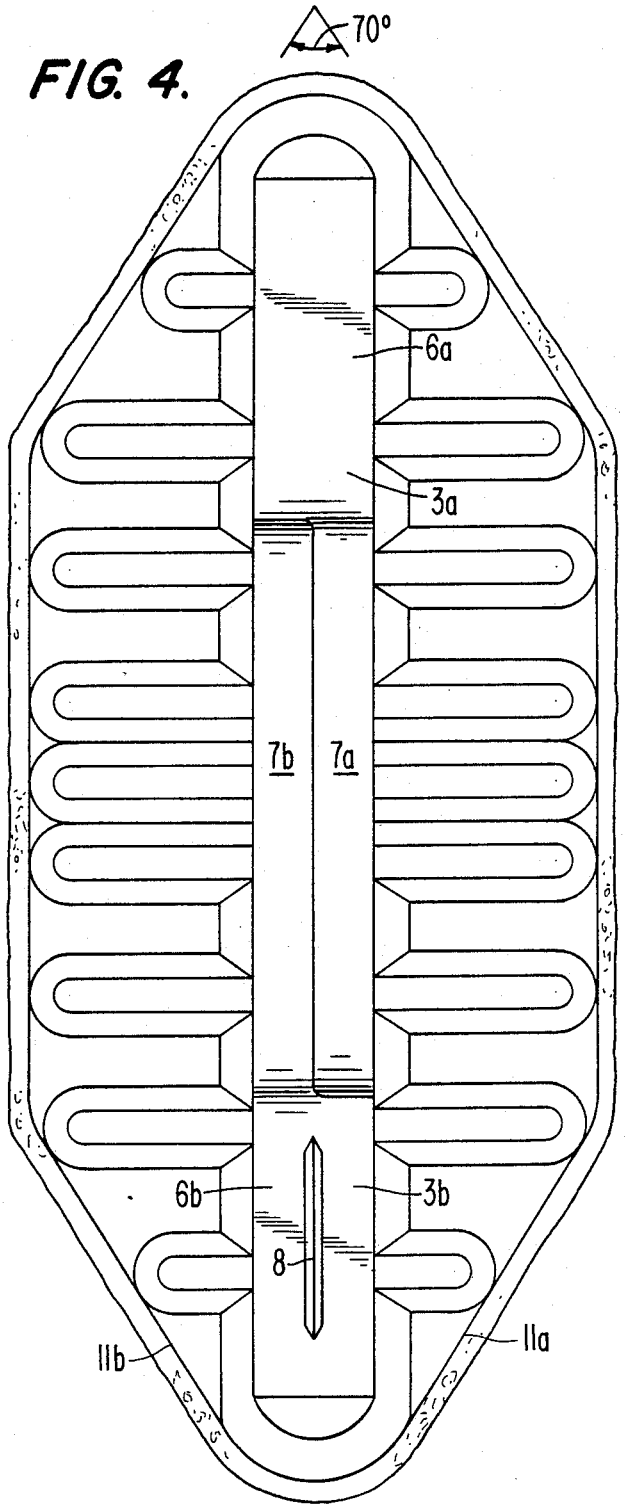
FIG. 4 shows a plan view of the utensil of FIG. 1.

FIG. 4 shows a plan view of the utensil in the FIG. 1 condition illustrating how, when the utensil is in the position for normal use, the two handle parts 3*a*, 3*b* co-operate to form the handle 4. The handle parts 3*a*, 3*b* comprise respective portions 6*a*, 6*b* by means of which they are attached to the plates 1*a*, 1*b* and portions 7*a*, 7*b* which overlap one another lengthwise of the holder and, being disposed in side by side abutting relation in the FIG. 1 condition, form the handle 4 extending along the utensil in spaced relation to the plates 1*a*, 1*b*, 1*c* to leave a gap to accommodate the user's knuckles when gripping the utensil. The handle parts 3*a*, 3*b* are provided with means whereby they may be latched in the FIG. 1 condition this may be achieved, for example by means of a pair of ball-and-socket detents on the two overlapping handle parts 7*a*, 7*b*.

FIG. 4 also illustrates how the holder parts and the pad are symmetrical about the hinge of the holder and how the outer ends of the plates 1*a*,1*c* and the pad are provided with converging side edges as at 11*a*,11*b* so that each end of the utensil tapers to a point, preferably with an included angle of 70 or thereabouts, to facilitate cleaning into corners. The tips of the ends of the holder parts may be rounded or blunted to avoid the risk of damaging surfaces.

As indicated above, the hinge width influences the efficiency of the wringing action and it is preferred that this width be between 0 and twice the thickness of the pad, at least in the case of a sponge pad, and that the hinge is provided with two parallel hinge lines rather than a single one. This can avoid the part of the pad closest to the hinge needing to be overly compressed in order to compress and wring the parts of the pad further from the hinge.

Figure 2:
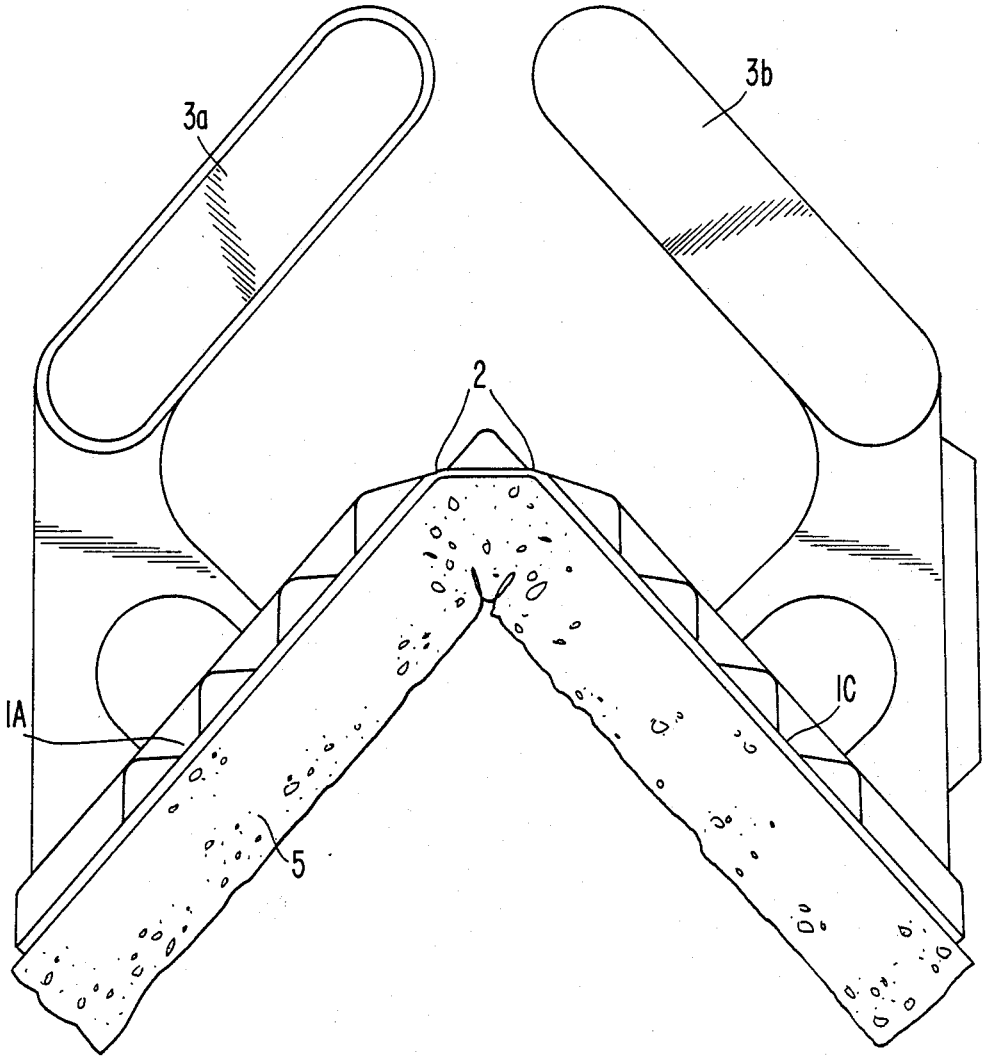
FIG. 2 shows a side view of the utensil in an intermediate position.

FIG. 2 shows the utensil in an intermediate position between the first position and the second position, when the sponge is to be filled, rinsed or replenished. The handle means 3 are separated and the hinges 2 swung so that two of the base plates, 1*a* and 1*c*, are moved towards one another thereby folding the sponge 5 in on itself.

Figure 3:
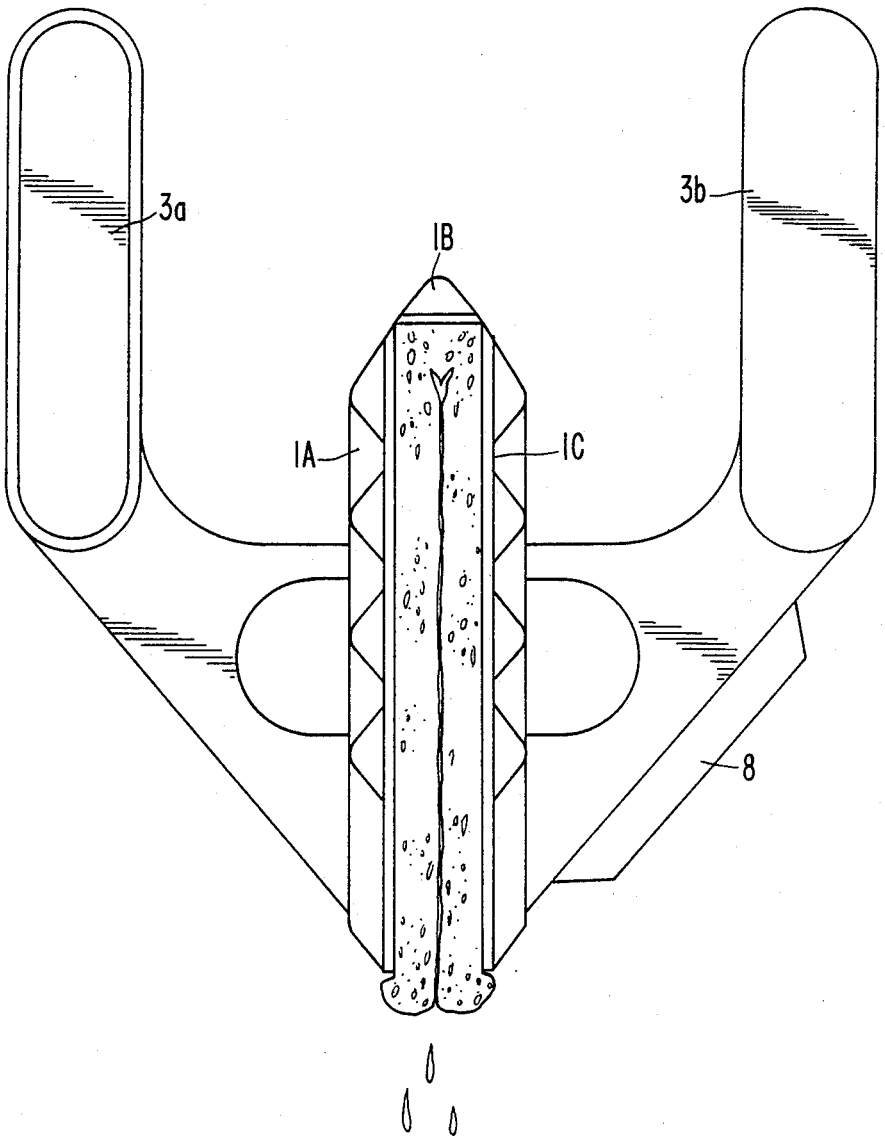
FIG. 3 shows the utensil in its second position in which the pad is squeezed.

FIG. 3 shows the utensil in its second position, and here the sponge is being squeezed and the handle means 3 are gripped by the user and used to press the holder parts 1*a* and 1*c* together thereby squeezing liquid out of the sponge. The provision of the strip-like part 1B relieves the squeezing action on the part of the pad 5 closest to the point of pivoting.

The Figures also show a scraper 8 provided as a raised ridge on one of the handle parts 3*a*, 3*b*.

Figure 5:
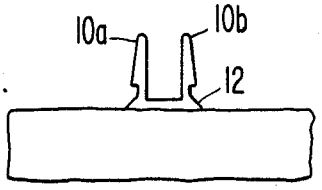
FIG. 5 is a sectional view of the pad illustrating the clipping arrangement by means of which the pad is releasably attached to the holder.

FIG. 5 illustrates an example of the preferred clipping arrangement whereby the pad 5 is releasably attached to the holder. To each side of the hinge is a semi-rigid body 12 of e.g. plastics material secured to the pad 5, for instance but not necessarily by gluing and having projecting from its surface and resiliently deformable clip tabs 10*a*,10*b* which spring into engagement with correspondingly shaped apertures in the side walls of the handle 3 (FIG. 1). The clip-tabs 10*a*,10*b* are shaped and dimensioned to correspond approximately with the size of the pad of a typical user's thumb, e.g. they can be about 2 cm wide and about 1.5 cm high, and placed at the junctions of the handle parts 6*a*,6*b* (FIG. 4) and the plates 1*a*,1*c* so as to provide a natural and convenient grip between the user's thumb and opposed forefinger.

Conveniently, for optimum efficiency of the wringing action, the underside of the holder is shaped complementarily to the upper surface of the pad, including the body 12. They need not, however, be exactly complementary; in particular the plates 1*a*,1*c* may be ridged to provide a compromise between material usage and rigidity.

Figure 6:
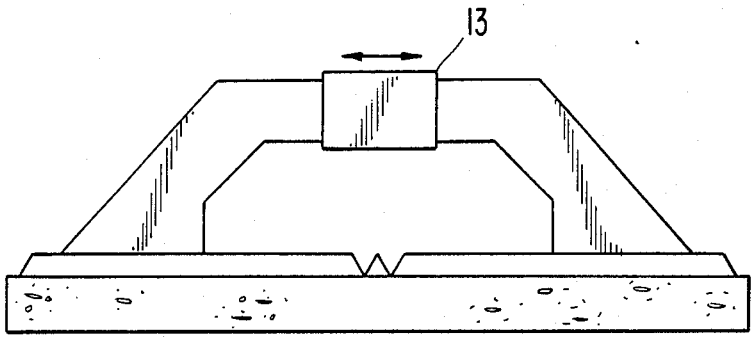
FIGS. 6 and 7 illustrate alternative versions of the holder part of the utensil.
Figure 7:
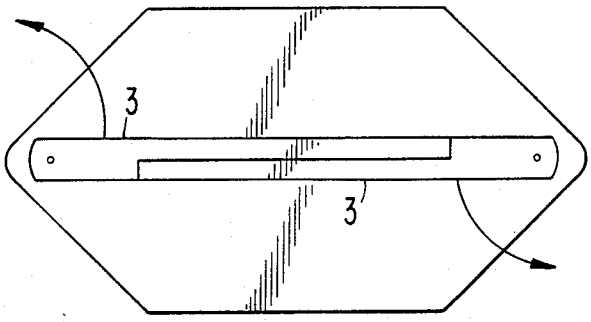

FIGS. 6 and 7 show variants of the handles. In FIG. 6, a sleeve 13 captive on one of the handles 3 is slidable on it from a position in which it engages the other handle 3 to form a unitary gripping handle to a second position in which the other handle 3 is freed for wringing purposes. FIG. 7 illustrates how each of the handles 3, irrespective of the means by which they engage in the FIG. 1 condition, may be rotatable through 180° so as to point outwardly and thereby increase the mechanical advantage in the wringing operation. As this rotation takes place about an axis at 90° to the hinge axis, it does not detract from the effective rigidity of the handles when used to wring out the pad.

Although the presently described utensil is intended to be used and wrung out directly by hand, for certain purposes the utensil may be fitted to a broom handle, for example, to increase its reach. For this purpose, one or both of the handle parts may be provided with a socket to enable the utensil to be secured on the end of such a handle; further an articulated mechanism may be provided to enable the user to operate the handles of the utensil from the broom handle.

I claim:

1. A hand-held utensil for surface cleaning, mopping and the like, comprising a pad of surface-treatment material, and a holder for the pad, the holder comprising parts which are movable relative to one another from a first working position in which the pad is used in normal use of the utensil to a second position in which the parts squeeze the pad, the holder parts having respective handles adapted to be directly gripped by the user and to enable the user to move the parts from the first working position to the second position, and wherein the handles, in the first working position of the holder parts, cooperate to form a handle arrangement extending along the holder which serves as a grip to enable the user to hold the utensil.

2. A utensil according to claim 1, wherein the holder comprises two such parts which are articulated together.

3. A utensil according to claim 2 wherein the holder parts are articulated together by means of an integral hinge.

4. A utensil according to claim 1 wherein the two handles in said first position overlap lengthwise of the holder and abut side by side in their overlapping regions.

5. A utensil according to claim 1 wherein each of the handles comprises a first part attached to and extending away from the associated holder part and a second part extending over the associated holder part and towards the other holder part.

6. A utensil according to claim 1 wherein the grip formed by the handles is spaced from the holder parts providing a gap to accommodate at least the ends of the user's fingers.

7. A utensil according to claim 1 wherein releasable means are provided for releasably holding the two holder parts in their first relative position.

8. A utensil according to claim 7 wherein the releasable means are provided on the overlapping regions of the two handles.

9. A utensil according to claim 7 wherein in the first position, the handles are disposed in side by side relation and are secured together by the releasable means.

10. A utensil according to claim 1 wherein the pad is permanently fixed to the holder.

11. A utensil according to claim 1 wherein the pad is releasably and replaceably attached to the holder.

12. A utensil according to claim 11 wherein the pad is releasably attached to the holder by co-operating means on the holder parts and the pad.

13. A utensil according to claim 12 wherein the pad is releasably attached to the holder parts by means of resiliently deformable elements.

14. A utensil according to claim 13 wherein the elements are located in the region of the holder parts where the corresponding handle is attached.

15. A utensil according to claim 13 wherein the resiliently deformable elements are fixed to the pad.

16. A utensil according to claim 15 wherein the elements comprise two opposed portions which can be squeezed together to release the elements from the holder.

17. A utensil according to claim 1 wherein opposite ends of the pad, and the overlying portions of the holder parts, have converging lateral walls.

18. A utensil according to claim 17 wherein the included angle between the converging lateral walls is approximately 70°.

19. A utensil according to claim 1 and further comprising a scraper formation on one of the holder parts.

* * * * *